US006357894B1

(12) United States Patent
Chu et al.

(10) Patent No.: US 6,357,894 B1
(45) **Date of Patent: *Mar. 19, 2002**

(54) LIGHTING FIXTURE HAVING FLUORESCENT SOURCE

(75) Inventors: Wai-Lam Chu; Chris Latsis, both of San Leandro, CA (US)

(73) Assignee: Prescolite, Inc., San Leandro, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/583,093

(22) Filed: May 20, 1999

Related U.S. Application Data

(63) Continuation of application No. 08/919,063, filed on Aug. 27, 1997, now Pat. No. 5,918,969.

(51) Int. Cl.[7] ..... F21V 7/09
(52) U.S. Cl. ..... 362/297; 362/260
(58) Field of Search ..... 362/217, 225, 362/260, 297

(56) References Cited

U.S. PATENT DOCUMENTS

| | | | | | |
|---|---|---|---|---|---|
| 4,519,019 | A | * | 5/1985 | Hau | 362/147 |
| 4,520,436 | A | * | 5/1985 | McNair et al. | 362/225 |
| 4,704,664 | A | * | 11/1987 | McNair | 362/225 |
| 4,947,297 | A | * | 8/1990 | Druffel et al. | 362/217 |
| 5,045,982 | A | * | 9/1991 | Lyons | 362/241 |
| 5,197,798 | A | * | 3/1993 | Tickner | 362/260 |
| 5,377,086 | A | * | 12/1994 | Tickner | 362/225 |
| 5,434,762 | A | * | 7/1995 | Shemitz | 362/225 |
| 5,463,540 | A | * | 10/1995 | Jones | 362/260 |
| 5,515,255 | A | * | 5/1996 | Nielson et al. | 362/297 |
| 5,523,931 | A | * | 6/1996 | Kassay et al. | 362/225 |
| 5,535,110 | A | * | 7/1996 | Lung | 362/297 |
| 5,550,723 | A | * | 8/1996 | Ullman | 362/260 |
| 5,555,162 | A | * | 9/1996 | Shemitz | 362/225 |
| 5,582,479 | A | * | 12/1996 | Thomas et al. | 362/277 |
| 5,584,575 | A | * | 12/1996 | Fickel | 362/260 |
| 5,716,125 | A | * | 2/1998 | Aubrey | 362/260 |

* cited by examiner

*Primary Examiner*—Alan Cariaso
*Assistant Examiner*—Hargobind S. Sawhney
(74) *Attorney, Agent, or Firm*—Theodore J. Bielen, Jr.

(57) ABSTRACT

A lighting fixture utilizing a housing surrounding a fluorescent light source. The housing has an aperture defining an edge portion for determining the cutoff angle of light emanating from the source. A first upper reflector is formed on the inner surface of the housing directing light from the source at angles ranging between the cutoff angle and angles less than the cutoff angle. The second reflector, located adjacent first reflector in the housing between the housing aperture and the first reflector, directs light from the source ranging between a selected angle, which is less than the cutoff angle, and at angles less than the selected angle. The result is a lighting fixture which possesses an optical delay in the activation in the second reflector as one approaches the optical axis from a peripheral position.

13 Claims, 3 Drawing Sheets

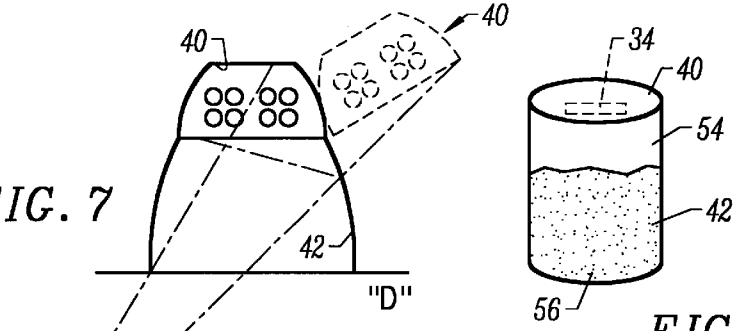
FIG. 4
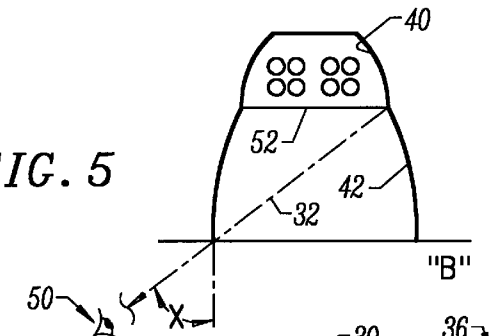
FIG. 5
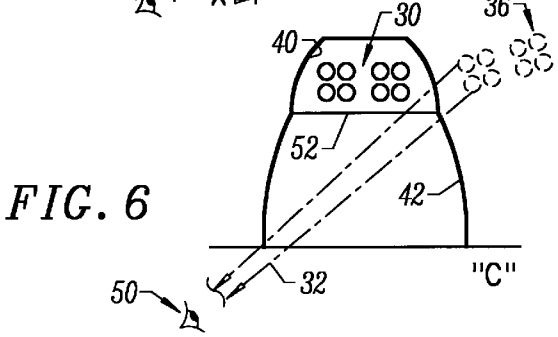
FIG. 6
FIG. 7
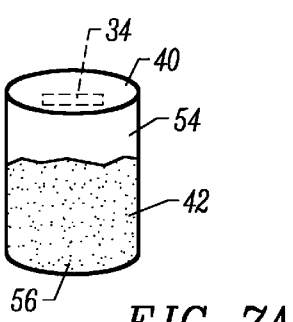
FIG. 7A
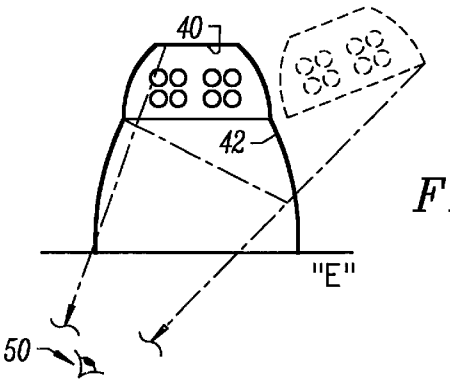
FIG. 8
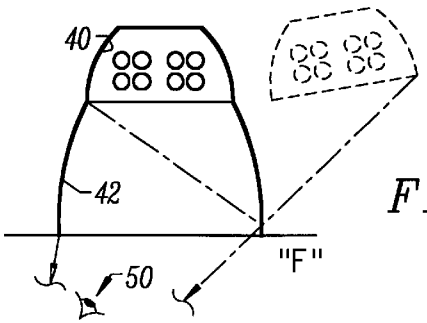
FIG. 9
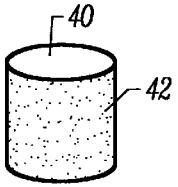
FIG. 6A

LIGHTING FIXTURE HAVING FLUORESCENT SOURCE

CROSS-REFERENCES TO RELATED APPLICATIONS

The present application is a continuation of patent application Ser. No. 08/919,063, filed Aug. 27, 1997, now U.S. Pat. No. 5,918,969, issued Jul. 6, 1999.

BACKGROUND OF THE INVENTION

The present invention relates to a novel lighting fixture which is particularly useful for employing compact fluorescent lamps.

Downlights are widely used to uniformly distribute light on a surface. In the past, incandescent "A-lamp" downlights were employed as the preferred system for downlighting applications, because such fixtures exhibited excellent brightness control and uniform distribution. The basic construction and "A-lamp" downlight includes a round incandescent lamp enclosed by a symmetrical circular appearing reflector.

Recent concerns with the cost of operating incandescent lamps has motivated the substitution of fluorescent lamps for incandescent lamps in downlight applications. Such fluorescent lamps are referred to as "PL" or "CFL" types. Compact fluorescent lamps are found in various configurations and wattages. For example, twin, quad, triple, and the like configurations are used in these lamps. Unlike round incandescent lamps, compact fluorescent lamps are, by nature, asymmetrical, especially when compact fluorescent lamps are positioned horizontally within the lighting fixture. Lighting fixtures utilizing compact fluorescent lamps, in the past, have encountered many problems. For example, "visual noise", such as striations, hot spots, distorted images, and the like, have been generated by horizontally positioned compact fluorescent lamps in downlights. In addition, the actual viewing of the horizontally positioned compact fluorescent lamp by an observer below the fixture creates a unfavorable aesthetic image. Moreover, glare from the reflector systems used with such fluorescent lamps is also pervasive in fluorescent downlight fixtures presently available. Although such problems have existed, there has been no alternative solution but to use fluorescent lamps in place of incandescent lamps in downlights, and to tolerate the many problems which have been delineated above.

Reference is made to U.S. Pat. Nos. 4,519,019, 5,045,982, and 5,515,255 which show reflector systems for ceiling lights which are generally of the incandescent type. Reflectors described in these patents are generally curved and lie above the lamp.

U.S. Pat. No. 5,582,479 shows a dual reflector system in which an incandescent lamp is used. One reflector is formed within the other reflector in this construction.

A lighting fixture utilizing a fluorescent light source that possesses many of the characteristics of an incandescent downlight would be a notable advance in the lighting field.

SUMMARY OF THE INVENTION

In accordance with the present invention a novel and useful downlight fixture utilizing a fluorescent light source is herein provided.

The lighting fixture of the present invention includes a housing which surrounds the fluorescent light source. The housing possesses an aperture that is defined by an edge portion. The aperture permits light to flow from the light source, while the edge portion of the aperture determines the cutoff angle of the light emanating from the fluorescent light source. The housing may be recessed in a ceiling or wall or be surface mounted as desired by the user.

The light source is generally in the form of a fluorescent lamp. Such fluorescent lamps are constructed in compact form, having one, two, three, or other number of tubes for the generation of light. The fluorescent light source may be mounted horizontally relative to the plane of the aperture of the housing.

A first reflector is formed on the inner surface of the housing to direct light from the fluorescent light source at certain angles. From the optical axis, which is generally coincident with the axis of the fixture, light is directed at angles ranging between the cutoff angle, determined by the housing edge portion, and at angles less than the cutoff angle. The first reflector, when the lighting fixture of the present invention is used in a ceiling, generally surrounds the top portion of the fluorescent lamps serving as the source of light. Of course, the first reflector may be specular surface, in this regard.

A second reflector is also formed on the inner surface of the housing. The second reflector is located adjacent the first reflector and may be, essentially, contiguous with the first reflector. The second reflector lies between the housing aperture and the first reflector, in any case. Light from the fluorescent source is directed by the second reflector outwardly through the aperture of the housing at a selected angle, which is less than the cutoff angle, and at other angles which are less than such selected angle. Thus, there is a gap between the highest angles of reflection of the first and second reflectors which creates a desirous "optical delay" from the perspective of an observer on the surface below the lighting fixture of the present invention, which will be detailed hereinafter. In addition, the second reflector is so formed that, as an observer approaches the optical axis of the fixture, becomes active beginning at the portion of the second reflector immediately adjacent the first reflector and continuing outwardly therefrom, as the observer moves closer to the optical axis. The result is that the present invention creates a reflector system that very closely mimics the effects of an incandescent lamp downlight and eliminates "visual noise" inherent in the prior art fluorescent downlights.

It may be apparent that a novel and useful lighting fixture has been described.

It is therefore an object of the present invention to provide a lighting fixture utilizing a fluorescent light source in the form of a highly asymmetrical horizontal compact fluorescent lamp, which produces a light distribution which is essentially symmetrical.

Another object of the present invention is to provide a lighting fixture utilizing a fluorescent light source which is suitable for a recessed lighting fixture and possesses minimum "visual noise" of the kind found in prior art fluorescent downlights.

A further object of the present invention is to produce a lighting fixture utilizing a fluorescent light source which includes a reflector system that results in projected light having an aesthetic quality similar to light emanating from an incandescent lamp.

Yet another object of the present invention is to provide a lighting fixture utilizing a fluorescent light source which is capable of operating with fluorescent lamps of various configurations.

Another object of the present invention is to provide a lighting fixture utilizing a fluorescent light source which is visually pleasing to an observer on the surface below the lighting fixture through the use of one of the reflectors of the reflector system of the lighting fixture of the present invention, which possesses an "optical delay" as the observer approaches the fixture.

Yet another object of the present invention is to provide a lighting fixture utilizing a fluorescent light source which possesses the qualities of sharp cutoff, low luminance, and high visual comfort probability, under accepted industry standards.

Another object of the present invention is to provide a lighting fixture utilizing a fluorescent light source which exhibits low glare.

The invention possesses other objects and advantages especially as concerns particular characteristics and features thereof which will become apparent as the specification continues.

BRIEF DESCRIPTION OF THE DRAWINGS

FIG. 4 is a schematic view of an observation of the lighting fixture of the present invention from beyond the cutoff angle.

FIG. 5 is a schematic view of an observation of the lighting fixture of the present invention at the cutoff angle.

FIG. 6 is a schematic view of the observation of the lighting fixture of the present invention within the cutoff angle.

FIG. 6A is a schematic view of the lighting fixture of the present invention as seen by an observer according to the observation point depicted in FIG. 6.

FIG. 7 is a schematic view of an observation of the lighting fixture of the present invention where both reflectors of the reflector system are active.

FIG. 7A is a schematic view of the lighting fixture of the present invention as seen by an observer on a surface according to the observation point depicted in FIG. 7.

FIG. 8 is a schematic view of an observation of the lighting fixture of the present invention where both reflectors are active and the fluorescent lamp is viewable.

FIG. 9 is a schematic view of an observation in which a first and second reflectors are fully active.

For a better understanding of the invention references made to the following detailed description of the preferred embodiments thereof which should be taken in conjunction with the prior described drawings.

DETAILED DESCRIPTION OF THE PREFERRED EMBODIMENTS

Various aspects of the present invention will evolve from the following detailed description of the preferred embodiments thereof which should be referenced to the prior detailed drawings.

Figure 1:
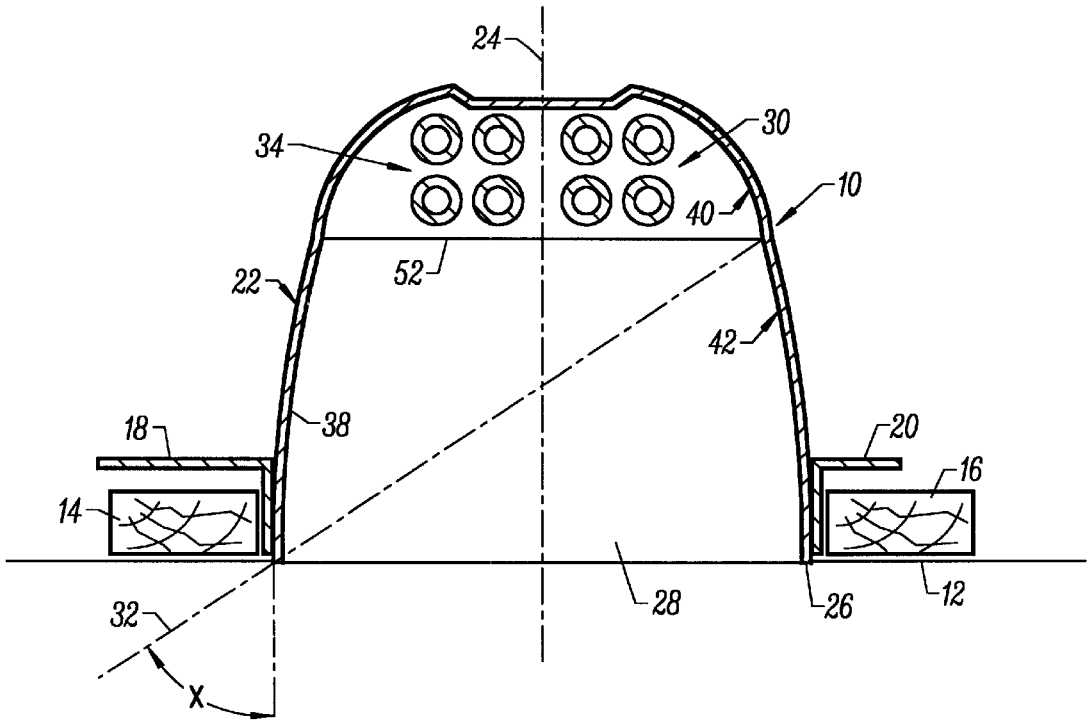
FIG. 1 is a sectional view of the lighting fixture of the present invention mounted within a ceiling as a recess lighting fixture.

The invention as a whole is depicted in the drawings by reference character 10. Lighting fixture 10 is shown in FIG. 1 in a typical application as a recessed lighting fixture. For example, fixture 10 is further shown as being sup ported by joists 14 and 16 within ceiling 12 through the use of brackets 18 and 20. Interconnection between fixture 10, brackets 18 and 20, and joists 14 and 16 are schematically depicted in FIG. 1, as this aspect of the drawing concerns conventional methods of attachment and mounting. Fixture 10 includes as one of its elements a housing 22 which is generally symmetrical about optical axis 24. Although housing 22 is illustrated as being an annular member, other configurations may suffice in this regard. Housing 22 terminates in an edge portion 26 which defines aperture 28 through which light emanates. Light source 30 is shown in FIG. 1 as a quad compact fluorescent lamp, although other types of fluorescent lamps may serve as light source 30, in this regard. Edge portion 26 defines optical cutoff angle "X", which is measured between optical axis 24 and ray line 32. Such cutoff angle "X" is adjustable and may vary between 40° and 65° in many cases.

Figure 2:
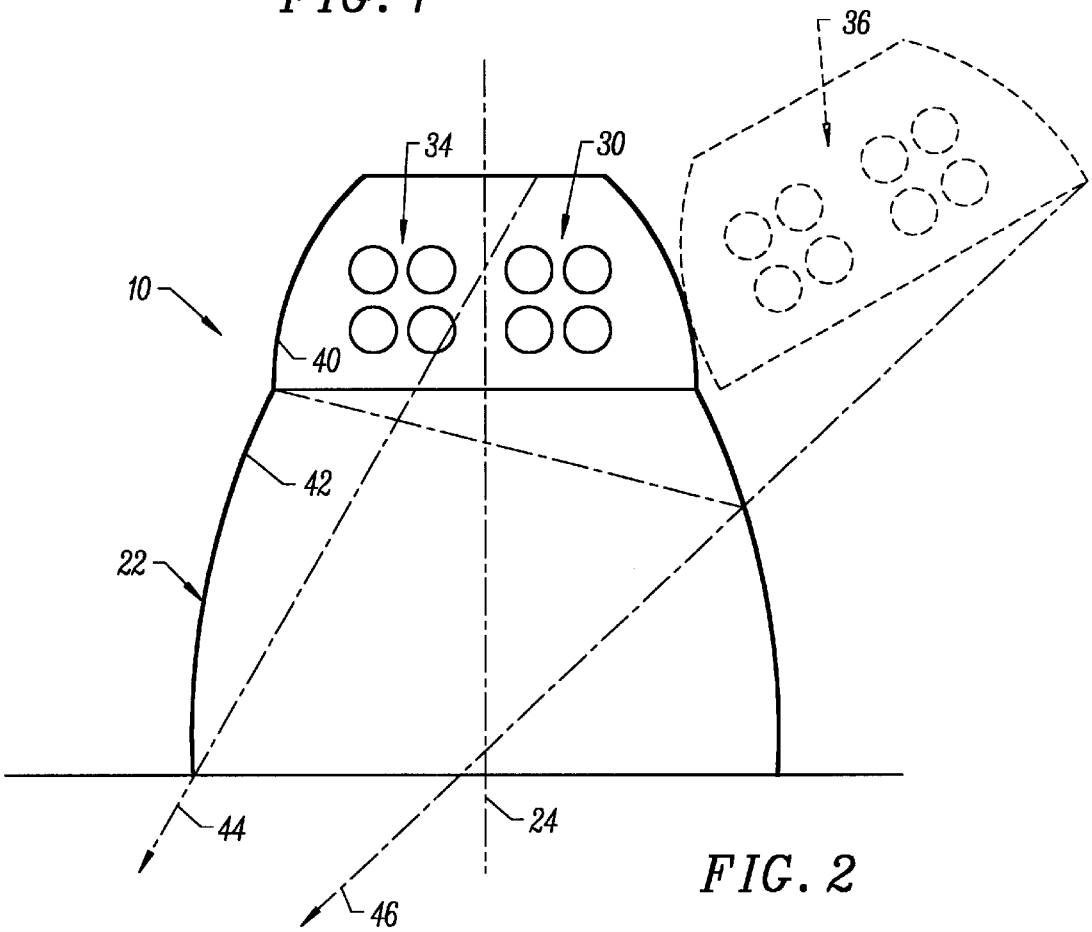
FIG. 2 is a schematic view of the lighting fixture of the present invention where an observer is viewing a virtual image of the fluorescent lamps used in the fixture of the present invention.

Turning to FIG. 2, lighting fixture 10 is depicted schematically. Light source 30 includes real lamps 34 as well as virtual lamps 36, the image of source 30, which are seen by an observer at certain angles from optical axis 24. The details of such observations will be further discussed hereinafter.

First reflector 40 is formed on inner surface 38 of housing 22. First reflector 40 directs light from source 30 outwardly from ceiling 12, usually to a ground surface. First reflector 40 is so formed as to direct light at angles from optical axis 24 ranging between the cutoff angle "X" and at angles less than cutoff angle "X". First reflector essentially serves as an upper reflector when lighting fixture 10 is mounted as shown in FIG. 1. Portions of upper reflector 40 lie above lamps 34 in this regard.

Lighting fixture 10 also includes as one of its elements second reflector 42, which is also formed on the inner surface 38 of housing 22. Second reflector functions to direct light from source 30 at angles ranging between a selected angle, which is less than cutoff angle "X" and at angles which are less than such select angle. That is to say, first reflector 40 projects light from fixture 10 at higher angles than does second reflector 42 and creates an "optical delay" in the activation of second reflector 42, which will be explained hereinafter. Ray lines 45 and 46 represent certain light projections from lighting fixture 10 as seen by an observer, shown in FIG. 2.

Figure 3:
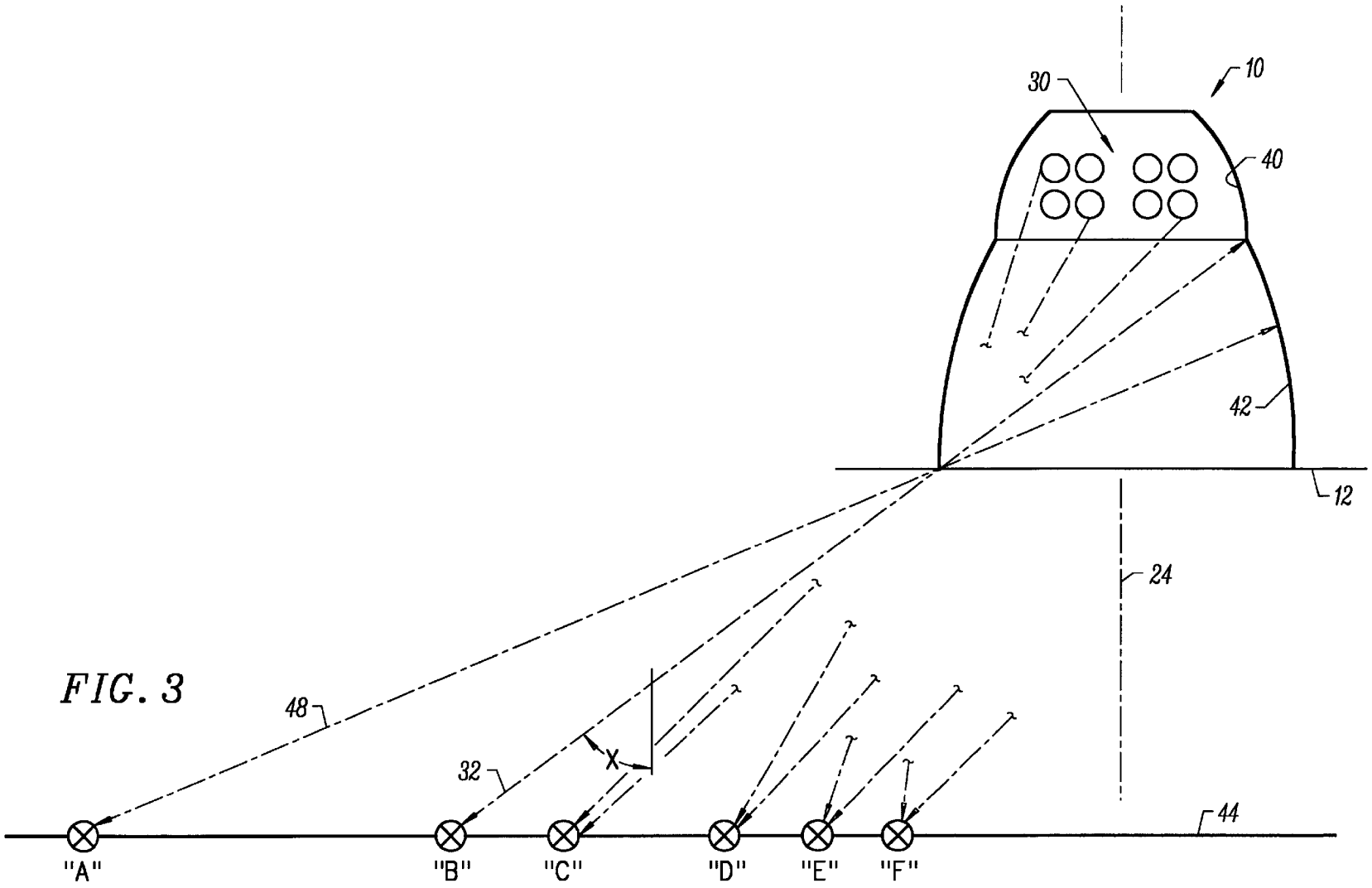
FIG. 3 is a schematic view of the lighting fixture of the present invention in which observations are shown at various distances from the optical axis of the fixture.

Referring now to FIG. 3, lighting fixture 10 is again depicted schematically within ceiling 12 as projecting light downwardly on a plane 44 which may be the eye of an observer above a ground surface, the top of a table, and the like. Various positions of an observer are shown in FIG. 3 and are noted by upper case letters A–F. That is to say, as an observer moves laterally inwardly toward optical axis 24, lighting fixture 10 assumes different appearance to the observer, dependent on the light projected from first and second reflectors 40 and 42. For example, observation position A would reveal lighting fixture 10 as being a dark body since no light is being projected from either first reflector 40 or second reflector 42. This is apparent since theoretical ray line 48 lies beyond cutoff angle "X" in which certain light is projected to plane 44. Ray line 32 depicts the position B in which light begins to flow from upper reflector 40. While lower reflector 42 remains as a dark body. Positions C–F will be further described in the following paragraph with reference to FIGS. 4–9.

FIGS. 4–9 depicts an observer, in plane 44 of FIG. 3 who is schematically noted by an eye symbol 50. FIG. 4 represents position A of FIG. 3 in which ray line 46 detects no light emanating from lighting fixture 10. That is to say, reflectors 40 and 42 do not project any light beyond cutoff angle "X".

FIG. 5 shows position B of FIG. 3 in which observer 50 sees transition line 52 between first and second reflectors. It should be noted that first and second reflectors lying adjacent to one another are, in certain cases, contiguous to one another. Thus, at angle "X" the cutoff angle, reflector 40 begins to project light downwardly toward observer 50. However, second reflector 42 remains inactive, projecting no light to observer 50 at this point. The luminance of the lower reflector 42 is uniform, also, at position B.

FIG. 6 shows position "C" of FIG. 3 in which observer 50 sees the virtual image 36 of real lamps 34 of light source 30. Virtual source 30 appears just above transition line 52 and is seen before the observer 50 directly sees real lamps 30. Lower reflector 42 is still inactive at this point. FIG. 6A depicts schematically the bright appearance of first reflector 40 and the dark appearance of lower reflector 42 which is seen by observer 50 at position C. Thus, the activation reflector 42 has been "optically delayed".

Moving closer to optical axis 24, FIG. 7 depicts what is seen by observer 50 at position "D", FIG. 3. Upper reflector 40 is still active and directing light at angles below cutoff angle "X" lower reflector 42 is beginning to become active and reflecting light at a certain angle which is less than cutoff angle "X". FIG. 7A depicts, schematically, an optically active first reflector 40 and partially active second reflector 42. Reflector portion 54 of reflector 42 is illuminated while reflector portion 56 of reflector 42 remains dark, the "optical delay" between position "B" and position "D" of second reflector 42 has ended. Second reflector 42 progressively illuminates downwardly, as the observer moves closer to optical axis 24 (leaving position D), from the top of reflector 42 downwardly. The observer 50 may view a portion of real lamps 34 at position "D", also. However, the virtual lamp image 36 is quite bright at this point. Thus, the distinction of lamps 34 from the light emanating from reflector 40 is difficult to observer 50.

Position "E" reveals light emanating from first reflector 40 in its entirety and light emanating from second reflector 42 almost in its entirety. A more direct view of lamps 34 is seen at position E by an observer 50.

FIG. 9 represents position "F" of FIG. 3 in which observer 50 sees light from first reflector 40 and second reflector 42, essentially in its entirety. In other words, there are no dark areas appearing in first and second reflectors 40 and 42, at this point.

It has been found, that the structure the light fixture of the present invention very carefully controls appearance of such light fixture, to an observer below in plane 44. Such control very closely follows light projection which one would expect from an incandescent downlight of the prior art, namely there is a sharp cutoff of light, low luminance, and a high visual comfort probability. Also, glare, which one might expect from lower reflector 42 as an observer approaches optical axis 24, is eliminated.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A lighting fixture utilizing a fluorescent light source for lighting a surface comprising:

a. a housing having an inner chamber containing the fluorescent light source, said housing further having an aperture to permit light to pass from the fluorescent light source, and an edge portion for determining the cutoff angle of light emanating from the fluorescent light source;

b. a first reflector located in the inner chamber of the housing, said first reflector directing light from the fluorescent light source ranging between said cutoff angle and at angles less than said cutoff angle; and c. a second reflector located in the inner chamber of the housing and located adjacent said first reflector, and between said housing aperture and said first reflector, said second reflector directing light from the fluorescent light source ranging between a selected angle less than said cutoff angle and at angles less than said selected angle, such that light reaching a surface between said cutoff angle and said selected angle less than said cutoff angle, only emanates from said first reflector.

2. The lighting fixture of claim 1 in which said first reflector at least partially surrounds the fluorescent light source.

3. The lighting fixture of claim 1 in which the fluorescent light source is a multiple tube fluorescent light source.

4. The lighting fixture of claim 3 in which said housing aperture essentially lies in a plane and said fluorescent source comprises an elongated fluorescent lamp oriented substantially parallel to said aperture plane.

5. The lighting fixture of claim 1 in which said second reflector directs light from the fluorescent source at a first instance utilizing the portion of said second reflector nearest said first reflector at said selected angle less than said cutoff angle.

6. The lighting fixture of claim 5 in which said second reflector further directs light from the fluorescent light source from said first instance, utilizing said portion of said second reflector nearest said first reflector, to subsequent instances progressively utilizing portions of said second reflector between said portion of said second reflector nearest said first reflector and the portion of said second reflector nearest said housing aperture, as said angles of light directed from the fluorescent source by the second reflector decrease from said selected angle.

7. The lighting fixture of claim 6 in which said first reflector at least partially surrounds the fluorescent light source.

8. The lighting fixture of claim 7 in which the fluorescent light source is a multiple tube fluorescent light source.

9. The lighting fixture of claim 8 in which said housing aperture essentially lies in a plane and said fluorescent source comprises an elongated fluorescent lamp oriented substantially parallel to said aperture plane.

10. The lighting fixture of claim 9 in which said first reflector directs light from the source at certain angles where direct light from the light source is absent.

11. The lighting fixture of claim 8 in which said first reflector is contiguous with said second reflector.

12. The lighting fixture of claim 1 in which said first reflector is contiguous with said second reflector in said housing inner chamber.

13. The lighting fixture of claim 1 in which said first reflector directs light from the source at certain angles where direct light from the light source is absent.

* * * * *